US009732446B2

(12) United States Patent
Favier et al.

(10) Patent No.: US 9,732,446 B2
(45) Date of Patent: Aug. 15, 2017

(54) HEAT RESISTANT OUTERSHELL FABRIC

(71) Applicant: E I DU PONT DE NEMOURS AND COMPANY, Wilmington, DE (US)

(72) Inventors: Frederique Favier, Dardilly (FR); Eduardo Munoz, Dingy en Vuache (FR); Yves Bader, Crozet (FR)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 379 days.

(21) Appl. No.: 14/529,257

(22) Filed: Oct. 31, 2014

(65) Prior Publication Data

US 2015/0121612 A1 May 7, 2015

Related U.S. Application Data

(60) Provisional application No. 61/899,396, filed on Nov. 4, 2013.

(51) Int. Cl.

| | |
|---|---|
| ***D03D 15/12*** | (2006.01) |
| ***D02G 3/04*** | (2006.01) |
| ***A62B 17/00*** | (2006.01) |
| ***D02G 3/44*** | (2006.01) |
| ***D03D 1/00*** | (2006.01) |
| ***D03D 15/00*** | (2006.01) |
| ***D03D 11/00*** | (2006.01) |
| *A41D 31/00* | (2006.01) |

(52) U.S. Cl.

CPC ..... *D02G 3/045* (2013.01); *A62B 17/003* (2013.01); *D02G 3/047* (2013.01); *D02G 3/441* (2013.01); *D02G 3/443* (2013.01); *D03D 1/0035* (2013.01); *D03D 11/00* (2013.01); *D03D 15/0005* (2013.01); *D03D 15/0027* (2013.01); *D03D 15/12* (2013.01); *A41D 31/0027* (2013.01); *D10B 2331/02* (2013.01); *D10B 2331/021* (2013.01); *Y10T 442/3146* (2015.04)

(58) Field of Classification Search

CPC .. A62B 17/003; A41D 13/015; A41D 13/008; B29C 70/24; D03D 15/00; D03D 15/12

USPC ..... 2/455, 81, 458, 902; 442/205, 213, 302

See application file for complete search history.

(56) References Cited

U.S. PATENT DOCUMENTS 4,994,317 A * 2/1991 Dugan ..... A41D 31/0027 428/402
5,928,971 A * 7/1999 Ellis ..... A41D 31/0022 442/118

(Continued)

FOREIGN PATENT DOCUMENTS

WO WO0066823 9/2000
WO WO0220887 3/2002

(Continued)

*Primary Examiner* — Tejash Patel

(57) ABSTRACT

The present invention relates to a thermally-resistant woven fabric and/or multiple ply fabric sheet for use as single or outer layer of protective garments, of the type comprising an inside fabric layer and an outside fabric layer joined together by an array of connecting lines. The woven fabric and/or multiple ply fabric sheet comprise yarns, wherein said yarn comprises i) meta-aramid
ii) from about 5 to 10 weight % of polyamide and
iii) at least 2 weight % of antistatic fibers, the weight % being based on the total weight of the yarn.

14 Claims, 3 Drawing Sheets

(56) References Cited

U.S. PATENT DOCUMENTS

| | | | | |
|---|---|---|---|---|
| 6,562,741 | B1 * | 5/2003 | Lilani | A41D 31/0022 428/357 |
| 6,974,785 | B1 * | 12/2005 | Barbeau | A41D 31/0022 169/45 |
| 7,402,538 | B2 * | 7/2008 | Bader | A41D 31/0022 139/420 R |
| 2011/0262704 | A1 * | 10/2011 | Rock | B32B 5/26 428/156 |
| 2012/0042442 | A1 * | 2/2012 | Takahashi | D03D 13/008 2/458 |
| 2014/0187113 | A1 * | 7/2014 | Hines, Jr. | D03D 1/0035 442/199 |
| 2016/0059050 | A1 * | 3/2016 | Gomez | A62B 17/003 2/458 |
| 2016/0230316 | A1 * | 8/2016 | Casanova Royo | D06P 3/82 |

FOREIGN PATENT DOCUMENTS

| | | |
|---|---|---|
| WO | WO02079555 | 10/2002 |
| WO | WO03039280 | 5/2003 |
| WO | WO03039281 | 5/2003 |
| WO | WO2004023909 | 3/2004 |
| WO | WO2006026538 | 3/2006 |

* cited by examiner

HEAT RESISTANT OUTERSHELL FABRIC

TECHNICAL FIELD

The present invention relates to a thermally-resistant woven fabric and/or multiple ply fabric sheet for use as single or outer layer of protective garments, of the type comprising an inside fabric layer and an outside fabric layer joined together by an array of connecting lines arranged so that the inside layer forms bubble-like pockets when the outside layer is caused to shrink by the external application of intense heat.

BACKGROUND ART

Thermally resistant fabric sheets for use as single or outer layer of protective garments are known in the art.

WO 00/66823 discloses a fire resistant material made of woven meta-aramid and polyamideimide fibers strengthened by an interwoven mesh of para-aramid fibers or polyparaphenylene terephthalamide, and fire resistant clothing made of this material.

WO 02/079555 discloses a reinforced fabric especially for thermal protection clothing, the fabric being reinforced by interlaced warp yarn weaves and weft yarn weaves of high-strength materials.

WO 02/20887 discloses a fire resistant material comprising a woven faced fabric composed of meta-aramid fibers, polyamideimide fibers and mixtures thereof, and a woven back fabric of low shrinkage fibers selected from para-aramid, polyparaphenylene terephthalamide copolymer and their mixtures. The two layers could be interwoven together at points forming a sort of grid.

WO 03/039280 describes a sheet of complex or multilayer structure especially intended for a thermal barrier in protective clothing for fire fighters, where the layers of material are interwoven to form pockets. The outer layer shrinks under the effect of heat to form pockets underneath, the pockets forming tubes along the inside face. FIGS. 5 and 7 of this prior art document illustrate the pockets and the interweaving pattern, respectively. WO 03/039281 describes a sheet of complex or multilayer structure for thermal barriers in fire fighters' protective clothing, where the layers of material are interwoven such that when the outer layer shrinks under the effect of heat the connecting fibers straighten to increase the space between the layers.

WO 2004/023909 (corresponding to EP 1 542 558), the content of which is incorporated by reference in its entirety in the present application, discloses a fabric for protective garments that is heat, flame and electric arc resistant. The fabric for use as single or outer layer of protective garments, comprises at least two separate single plies each having a warp and a weft system, the at least two separate single plies being assembled together at predefined positions so as to build pockets, the warp and the weft systems of the at least two separate single plies being based on materials independently chosen from the group consisting of aramid fibers and filaments, polybenzimidazol fibers and filaments, polyamidimid fibers and filaments, poly (paraphephenylene benzobisaxazole) fibers and filaments, phenol-formaldehyde fibers and filaments, melamine fibers and filaments, natural fibers and filaments, synthetic fibers and filaments, artificial fibers and filaments, glass fibers and filaments, carbon fibers and filaments, metal fibers and filaments, and composites thereof.

Due to its peculiar structure, this fabric may have a specific weight which is considerably lower than that of known fabrics having comparable mechanical and thermal properties.

Another aspect of WO 2004/023909 is a garment for protection against heat, flames and electric arc comprising the above fabric as single or outer layer.

The garment according to WO 2004/023909 strongly improves the wearer's comfort both during normal and critical situations. It is lighter and thinner than conventional garments having similar mechanical and thermal properties and it enables a higher heat and vapour dissipation from the wearer surface to the environment.

WO 2006/026538 (corresponding to EP 1 796 492), the content of which is incorporated by reference in its entirety in the present application discloses a thermally resistant composite fabric sheet wherein the array of connecting lines is constituted by a plurality of isolated single connecting lines and/or by a plurality of isolated groups of connecting lines. The connecting lines are arranged at different angles and are spaced apart from one another to leave, between the isolated single connecting lines and/or between the isolated groups of connecting lines, gaps where the two layers are not connected to one another. These gaps unite a continuous expanse of the two unconnected layers that surrounds each isolated connecting line and/or each isolated group of connecting lines. This continuous expanse of the unconnected fabric layers has a labyrinth-like structure delimited by the connecting lines at different angles such that, when a given area of the outside layer is subjected to intense heat resulting in thermal shrinkage, the inside layer forms under the given area a series of self-closing bubble-like pockets that form individually in discrete areas of the continuous expanse between the connecting lines and that are inhibited by the labyrinth-like structure from propagating along or across the sheet outside said given area.

The connecting lines or groups of connecting lines are isolated and surrounded like islands in the expanses of unconnected fabric layers, with the connecting lines at angles forming a sort of labyrinth that prevents the bubbles from forming tubes. The connecting lines are conveniently arranged in a geometrically repeating pattern with the continuous expanse forming wavy paths that meander around the pattern of lines. The connecting lines can for example be arranged in a plurality of groups each composed of a plurality of connecting lines arranged for instance in a generally Y, V, L, T, H, X or Z configuration with the lines extending from at least one convergence point, the lines being connected together at, or being spaced apart from, their convergence point(s).

The special structure of the thermally-resistant composite fabric sheet according to WO 2006/026538 provides an improved combination of properties over prior art structures, in particular a combination of high thermal performance with improved physical characteristics after the fabrics have been exposed to heat, which leads to enhanced wearer comfort due to the fact that these performances can be achieved with fabrics of lower weight. Therefore, garments of the same thermal performance can be made with lighter fabrics, making the garments more comfortable to wear.

When the outer face of the fabric according to the invention is, for example, exposed to a flame or another intense source of heat, the outside fabric layer is caused to shrink. The inside layer is shielded from the heat source and does not shrink, or shrinks much less. Shrinkage of the outside fabric layer is constrained by the connecting lines that are isolated in a pattern, surrounded by the unconnected layers. The bubble-like pockets that form are localized under the heated area; the limited propagation of these self-closing pockets means that the thus-formed insulating space is effective to protect the underlying area. Thus, heat is not unwantedly transmitted to adjacent areas by the formation of tubes. This formation of bubble-like air spaces under the area that is exposed to intense heat provides the high thermal performance of the fabric.

After exposure to intense heat, the fabric also has improved physical characteristics, namely a good tear resistance and tensile strength. When the heated outside layer shrinks, it acts as a heat absorber, sacrificing some of its physical strength, while the inside layer remains intact. Furthermore, the connecting lines uniting the two fabric layers also sacrifice some physical strength leading to a weakness of the fabric along such lines where the fabric can tear. However, due to the peculiar discontinuity in the connecting lines and the resulting unconnected expanses of the fabric according to the present invention, such tears cannot propagate to other zones which have not been exposed to heat and which are therefore undamaged. As a result, the outer layer of the fabric sheet demonstrates good tear resistance and tensile strength after exposure to intense heat, the inside layer remaining protected and the intact unconnected expanse of the inside layer retaining its strength. This could be extremely important for firemen's clothing where, for example, a fireman in a burning structure has to be pulled by his clothing to remove him from a critical situation.

Despite these proposals, there remains a need for thermally-resistant fabrics that combine wearer comfort, high thermal performance, high resistance to abrasion, high durability, improved mechanical performances and electrical arc protection.

SUMMARY OF THE INVENTION

An aim of the present invention is to propose improved materials and composite fabric sheets that may be used as protective garments, for example for firemen and other applications wherein the wearers may be exposed to intense heat.

The woven fabric and/or multiple ply fabric sheet according to the present invention provide high thermal performance, improved physical characteristics and excellent electric arc protection while contributing to the wearer comfort.

The garments made with the woven fabric and/or multiple ply fabric sheet according to the present invention are lighter, more flexible and thus more comfortable to wear.

In addition to good physical properties like tensile strength and tear strength, the woven fabric and/or multiple ply fabric sheet according to the present invention displays excellent abrasion resistance that is appreciated particularly for outershell fabrics.

DETAILED DESCRIPTION

Figure 1:
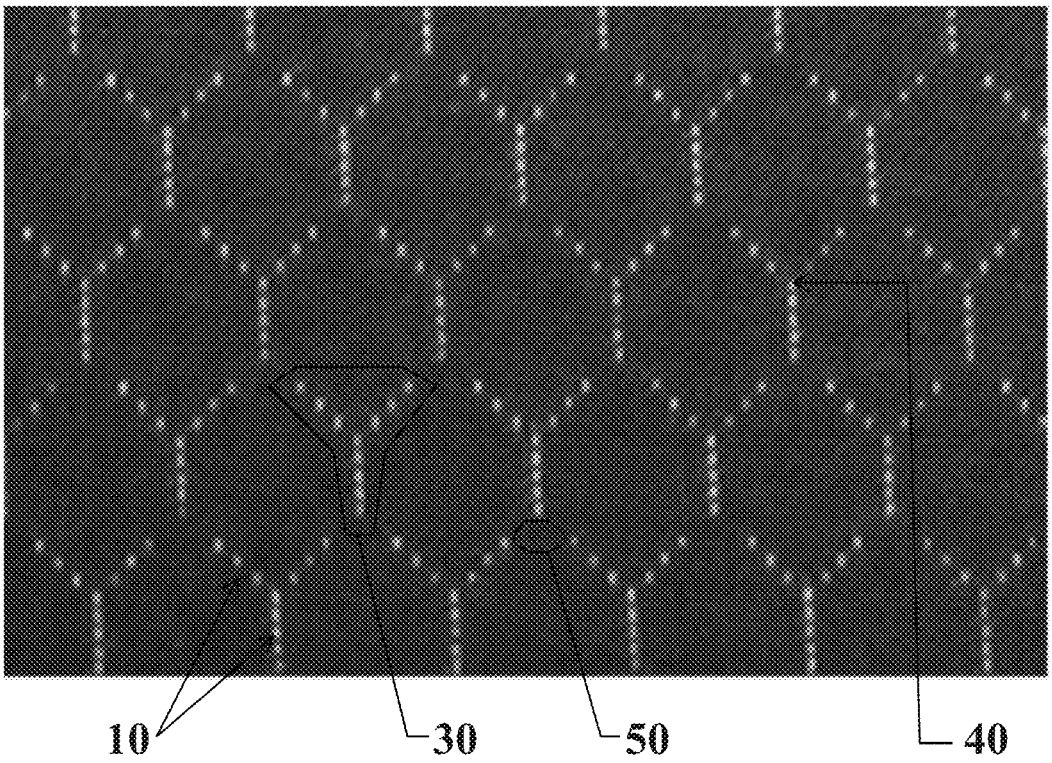
FIG. 1 is a picture of the outside fabric layer (A) of a multiple ply fabric sheet according to the invention, with an array of Y-shaped connecting lines.

Disclosed herein is a yarn for a thermally resistant fabric sheet, wherein said yarn comprises:

i) meta-aramid ii) from about 5 to 10 weight % of polyamide and iii) at least 2 weight % of antistatic fibers, the weight % being based on the total weight of the yarn.

In a preferred embodiment, the yarn of the present invention comprises approximately i) 91 weight % meta-aramid ii) 7 weight % polyamide iii) 2 weight % antistatic fibers, the weight % being based on the total weight of the yarn.

The polyamide used in the yarns of the present invention is selected from the group of aliphatic and semi-aromatic polyamide, preferably aliphatic polyamide. Particularly preferred is a polyamide 66.

Antistatic fibers are selected from the group consisting of carbon core polyamide sheath or metal core polyamide sheath.

In a preferred embodiment, the count of the yarns of the invention has a linear density Nm from about 40/2 to about 140/2, more preferably about 80/2.

A woven fabric according to the present invention can be made with the yarns disclosed above. In particular, the same yarns could be used for both the warp and weft of the fabric.

In a preferred embodiment, the woven fabric is a plain weave.

In another embodiment, multiple ply fabric sheets comprising at least one ply made of the woven fabric described above are provided.

Multiple ply fabric sheets of the present invention can be made of two plies wherein one ply is formed by an inside fabric layer (B) and the other ply by an outside fabric layer (A) joined together by an array of connecting lines (10).

Preferably, the two plies are interwoven together, by known techniques, and the connecting lines (10) are made with the yarns of the inside fabric layer (B) and/or outside fabric layer (A). Preferably, the connecting lines (10) are made with the yarns of the inside fabric layer (B).

Preferably, the multiple ply fabric sheet of the present invention is a two-ply fabric wherein one ply, the outside fabric layer (A), is made with the woven fabric of the present invention and the other ply, the inside fabric layer (B), is made of a yarn that is both heat resistant and has low thermal shrinkage, such as polyparaphenylene terephtalamide (para-aramid), polyamideimide, and copolyimide. Particularly preferred is multiple ply fabric sheet wherein the inside fabric layer (B) is made of a yarn 100% para-aramid yarn. The yarn count of the inside fabric layer (B) can be the same or different than the yarn count of the outside fabric layer (A). Particularly preferred is a two-ply fabric wherein the inside fabric layer (B) and the outside fabric layer (A) have a plain weave construction with the same yarn count and the same number of yarns per centimeter in both warp and weft directions.

When exposed to intense heat, the outside layer (A) is caused to shrink and because of the connecting lines (10) the inside layer (B) is buckling leading to an increased thickness of the multiple ply fabric sheet wherein air is entrapped between the plies.

As shown in FIG. 1, the array is made up of a plurality of connecting lines being arranged in an isolated group (30), each group being composed of three connecting lines (10) arranged in a Y shape.

In on preferred embodiment, two of the three connecting lines (10) of each Y are of substantially equal length and extend at substantially equal angles (of) 120° from a convergence point (40) where the connecting lines (10) are connected together.

In the example of FIG. 1, the three connecting lines (10) of each Y are all parallel to corresponding lines (10) of the other Y-shaped groups. Moreover the parallel lines (10) of different groups are all exactly or approximately aligned with and parallel to lines (10) of the other groups. So, the vertical stems of the Ys are aligned in vertical rows, and the inclined arms of the Ys are also aligned along rows. The Y-shapes of every alternate vertical row of the Y shapes are aligned both vertically and horizontally, as can be seen for the left and right vertical rows in FIG. 1.

Each Y-shaped group (30) of connecting lines (10) is isolated from the other groups. The connecting lines (10) are arranged at different angles and are spaced apart from one another to leave, between the isolated Y-shaped groups of connecting lines (10), gaps (50) where the two layers (A), (B) are not connected to one another.

Other shapes of grouped connecting lines are possible, for example L-shapes, T-shapes, H-shapes, X-shapes, Z-shapes and so on (with or without gaps in the shapes), and it is also possible to include a plurality of curved connecting lines as individual lines in say C-shape or S-shape, or grouped lines where two straight lines are connected by a curved section for example to form a U-shape. Various shapes and patterns can also be composed from an array of individual isolated connecting lines.

A two ply fabric is one specific embodiment but other configurations are envisaged with more layers than only two.

The woven fabric and/or the multiple ply fabric sheet of the present invention are also suitable to make garments, in particular garments for exposure to high temperature environments. In particular, the woven fabric and/or the multiple ply fabric sheet of the present invention can be used as the outer layer of such garments. In the case of multiple ply fabric sheet, the outside fabric layer (A) of the fabric sheet is disposed on the outside of the garment. Optionally, the woven fabric and/or the multiple ply fabric sheet of the present invention can be used in association with breathable membrane and/or lining to make a garment.

The garment according to the present invention can be manufactured in any possible way. The garment can be made from a multilayer structure. Such multilayer structure preferably comprises, but is not limited to, an internal layer (lining), optionally an intermediate layer made of a breathable waterproof material, and an outer layer made of the multiple ply fabric sheet according to the invention. The most internal layer directly faces the wearer's skin or the wearer's underwear.

The garment according to the present invention can be of any kind including, but not limited to, jackets, coats, trousers, gloves, overalls and wraps

EXAMPLES

Example 1 of the Invention

A two-ply woven fabric sheet (layer A and layer B) was prepared with the following two yarn combination.

A blend of fibers consisting of:

91 weight % of meta-aramid having a cut length of approximately 100 mm;

7 weight % of polyamide 66 and 2 weight % of antistatic fibers made of carbon core polyamide sheath spun into one type of single long staple yarns Y-A1 using long staple processing equipment.

Single Yarn Y-A1 had a linear density of Nm 80/1 and a twist of 850 Turns Per Meter (TPM) in the Z direction. Two single Y-A1 yarns were then plied and twisted together. The resulting plied and twisted yarn (TY-A1) had a linear density of Nm 80/2 and a twist of 760 TPM in the S direction. TY-A1 was subsequently treated with steam to stabilize its tendency to wrinkle TY-A1 yarns were used as warp yarn and weft yarn for forming the first ply (layer A).

For the second ply, the weft and warp Y-B1 yarns were prepared as follows: 100 weight % para-aramid stretch broken fibers were ring spun into a single staple yarn Y-B1 using a long staple processing equipment.

Single yarn Y-B1 had a linear density of Nm 80/1 and a twist of 700 TPM in the Z direction. Two single Y-B1 yarns were then plied and twisted together. The resulting plied yarn (TY-B1) had a linear density of Nm 80/2 and a twist of 700 TPM in the S direction. TY-B1 was subsequently treated with steam to stabilize its tendency to wrinkle TY-B1 was used as warp yarn and weft yarn for the second ply.

A fabric weave having an array of Y-shaped connecting lines like in FIG. 1 was prepared. This weave fabric had 45 yarns/cm (warp) (22.5 yarns/cm for each ply), 45 ends/cm (weft) (22.5 ends/cm for each ply) and a specific weight of 240 g/m2.

The performance of the multiple ply fabric sheet is given hereunder in table 1.

Comparative Examples 1 and 2

Comparative examples 1 and 2 were made with different yarns and weaving construction than example 1. However, the weight of the multiple ply fabric sheet is substantially the same for Example 1, comparative example 1 and comparative example 2.

Specific yarn and construction are given in table 1 for comparative examples 1 and 2.

The examples confirm the superior performance of the multiple ply fabric sheet according to the invention.

As shown in table 1, multiple ply fabric sheet of example 1 shows high mechanical, thermal and electric arc performances, very good abrasion resistance, very good durability (no fibrillation of para-aramid, good color retention), soft hand, while the multiple ply fabric sheets of comparative examples 1 and 2 show lower abrasion and snagging resistance. In addition the comparative examples show poor durability when washed several times compared to the example of the invention.

Properties measurements were made according to standards (ISO, ASTM etc. . . . ) and are given in table 1.

ATPV stands for Arc Thermal Performance Value.

FFF stands Fabric Failure Factor.

TABLE 1

| | | | EXAMPLE 1 | | COMPARATIVE EXAMPLE 1 | | COMPARATIVE EXAMPLE 2 |
|---|---|---|---|---|---|---|---|
| warp | yarn 1 | 80/2 | 91% meta-aramid<br>7% polyamide 66<br>2% antistatic fibers<br>Long staple | 70/2 | 93% meta-aramid<br>5% para-aramid<br>2% antistatic fibers<br>Short staple | 100/2 | 93% meta-aramid<br>5% para-aramid<br>2% antistatic fibers<br>Short staple |
| | yarn 2 | 80/2 | 100% para-aramid<br>Stretch broken | 70/2 | 100% para-aramid | 100/2 | 100% para-aramid |
| weft | yarn 1 | 80/2 | 91% meta-aramid<br>7% polyamide 66<br>2% antistatic fibers<br>Long staple | 70/2 | 93% meta-aramid<br>5% para-aramid<br>2% antistatic fibers<br>Short staple | 100/2 | 93% meta-aramid<br>5% para-aramid<br>2% antistatic fibers<br>Short staple |
| | yarn 2 | 80/2 | 100% para-aramid<br>Stretch broken | 70/2 | 100% para-aramid | 100/2 | 100% para-aramid |

TABLE 1-continued

Figure 2:
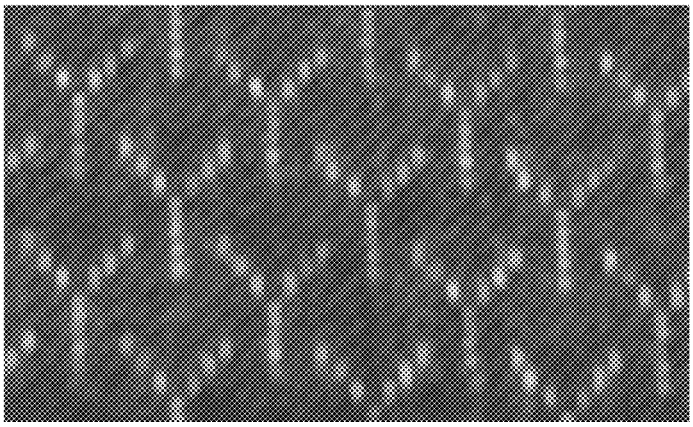
FIG. 2 is a picture of the outside fabric layer (A) of a multiple ply fabric sheet according to comparative example 1.
Figure 3:
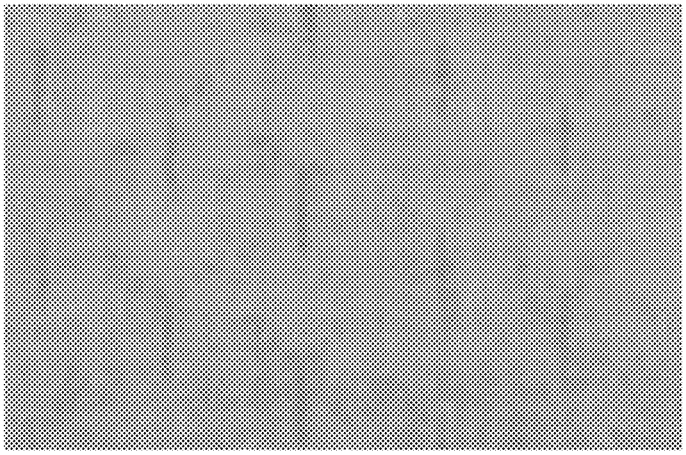
FIG. 3 is a picture of the outside fabric layer (A) of a multiple ply fabric sheet according to comparative example 2.
Figure 4:
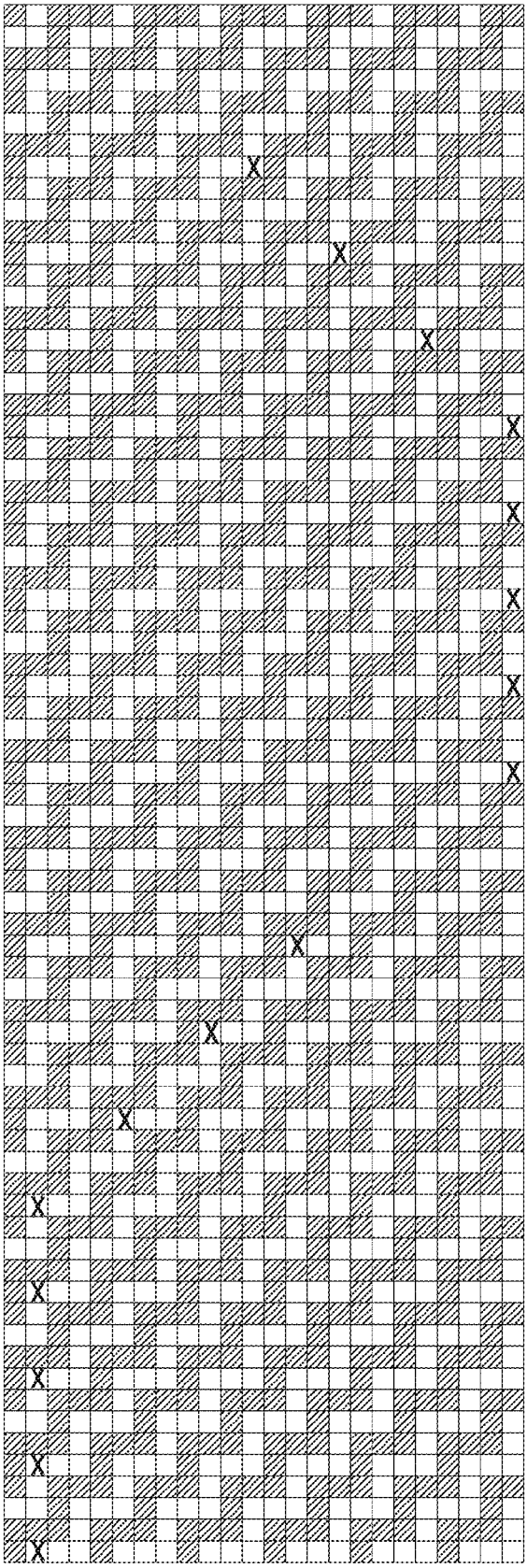
FIG. 4 is the weaving construction of a multiple ply fabric sheet according to example 1 of the invention.

| | EXAMPLE 1 | COMPARATIVE EXAMPLE 1 | COMPARATIVE EXAMPLE 2 |
|---|---|---|---|
| weight (g/m2) | 240 | 239 | 232 |
| ratio face (A):face (B) | 1:1 | 1:1 | 1:1 |
| construction (yarns/cm) | 45 × 45 | 41 × 41 | 56 × 56 |
| weave | Plain weave<br>See FIG. 1 | Twill 2/1<br>See FIG. 2 | Plain weave<br>See FIG. 3 |
| tensile strengths (N)<br>ISO 13934-1 | 2600<br>2900 | 2770<br>2780 | 2280<br>2830 |
| tear strengths (N)<br>ISO 13934-2 | 240<br>260 | 284<br>329 | 117<br>165 |
| abrasion (cycles)<br>ISO 12947-2 | 72000 | 48000 | 18000 |
| air permeability (l/m2/s)<br>ISO 9237 | 245 | 317 | 184 |
| FFF = (TPP/weight) * 100<br>84 kW/m2, spacer<br>ISO 17492 | 6.8 | 6.98 | 6.72 |
| snagging<br>ASTM D3939-2 | 3<br>4 | 3<br>3-4 | |
| pilling (4000 cycles)<br>ISO 12945-2 | 4 | 3-4 | 3-4 |
| ATPV (cal/cm2)<br>EN 61482-1-1 | 16 | 24 | 12 |

The invention claimed is:

1. A yarn for a thermally resistant fabric sheet, wherein said yarn comprises i) meta-aramid ii) from about 5 to 10 weight % of polyamide and iii) at least 2 weight % of antistatic fibers, the weight % being based on the total weight of the yarn, wherein the polyamide is either an aliphatic or semi-aromatic polyamide.

2. The yarn according to claim 1, wherein said yarn comprises approximately i) 91 weight % meta-aramid ii) 7 weight % polyamide iii) 2 weight % antistatic fibers, the weight % being based on the total weight of the yarn.

3. The yarn according to claim 1 or 2, wherein the linear density Nm of the yarn is from about 40/2 to about 140/2.

4. The yarn of claim 3, wherein the linear density Nm of the yarn is about 80/2.

5. A woven fabric sheet comprising the yarn of claim 1 or 2.

6. The woven fabric according to claim 5, wherein warp and weft are made from the same yarn.

7. The woven fabric according to claim 5, wherein the fabric is a plain weave.

8. A multiple ply fabric sheet comprising at least one ply made of the woven fabric of claim 5.

9. The multiple ply fabric sheet according to claim 8, wherein said fabric is a two-ply fabric and wherein the other ply is made of a 100% para-aramid yarn.

10. The fabric sheet according to claim 8, wherein said fabric is a two-ply fabric and wherein the two plies are formed by an inside fabric layer (B) and an outside fabric layer (A) joined together by an array of connecting lines (10).

11. The fabric sheet of claim 10, wherein the inside fabric layer (B) and outside fabric layer (A) are both woven fabrics and are joined together by an array of woven connecting lines (10) formed by interwoven threads making up the fabrics.

12. The fabric sheet according to claim 10, wherein the array of connecting lines (10) is constituted by a plurality of connecting lines being arranged in an isolated group (30) of a generally Y-shaped configuration with three lines extending from a convergence point (40), the lines being connected together at their convergence point and wherein each isolated group is spaced apart from one another.

13. A garment, in particular a garment for exposure to high temperature environments, comprising the woven fabric sheet of claim 5.

14. A garment, in particular a garment for exposure to high temperature environments, comprising the woven fabric sheet of claim 10, wherein the outside fabric layer (A) of the fabric sheet is disposed on the outside of the garment.

* * * * *